US012774018B2

(12) United States Patent
Seenumani et al.

(10) Patent No.: US 12,774,018 B2
(45) Date of Patent: Oct. 27, 2026

(54) VEHICLE CONTROL SYSTEM AND METHOD

(71) Applicant: Transportation IP Holdings, LLC, Norwalk, CT (US)

(72) Inventors: Gayathri Seenumani, Niskayuna, NY (US); Harry Kirk Mathews, Clifton Park, NY (US); Brian Nedward Meyer, Fairview, PA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 0 days.

(21) Appl. No.: 18/340,460

(22) Filed: Jun. 23, 2023

(65) Prior Publication Data

US 2024/0025462 A1 Jan. 25, 2024

Related U.S. Application Data

(60) Provisional application No. 63/391,117, filed on Jul. 21, 2022.

(51) Int. Cl.
*B61L 25/02* (2006.01)
*B61L 15/00* (2006.01)

(52) U.S. Cl.
CPC ..... *B61L 25/02* (2013.01); *B61L 15/0058* (2024.01); *B61L 15/0062* (2024.01); *B61L 15/0072* (2013.01)

(58) Field of Classification Search
CPC .. B61L 25/02; B61L 15/0058; B61L 15/0062; B61L 15/0072; B61L 27/12; B61L 27/14; B61L 27/16
USPC ..... 701/19
See application file for complete search history.

(56) References Cited

U.S. PATENT DOCUMENTS

| | | | | |
|---|---|---|---|---|
| 5,604,676 | A * | 2/1997 | Penzias | G06Q 30/0284 705/417 |
| 7,822,539 | B2 * | 10/2010 | Akiyoshi | G01C 21/343 701/429 |
| 7,937,214 | B2 * | 5/2011 | Kaneda | G08G 1/096827 340/988 |
| 10,183,684 | B2 | 1/2019 | Mathews, Jr. et al. | |
| 10,676,115 | B2 | 6/2020 | Mathews, Jr. et al. | |
| 12,067,509 | B2 * | 8/2024 | Phillips | G06F 18/22 |
| 2007/0219681 | A1 * | 9/2007 | Kumar | B61L 25/025 701/19 |
| 2008/0033633 | A1 * | 2/2008 | Akiyoshi | G06Q 10/025 701/418 |

(Continued)

*Primary Examiner* — Grant Moubry
*Assistant Examiner* — Ruben Picon-Feliciano
(74) *Attorney, Agent, or Firm* — K&L Gates LLP

(57) ABSTRACT

A vehicle control system and method may include one or more processors that may receive a data set associated with plural waypoint locations along one or more routes. The data set may indicate plural waypoint locations, target arrival time windows for a vehicle system to reach the plural waypoint locations, and priority ranks of the plural waypoint locations. The processors may create and/or adjust a pacing trip plan based on the data set. The pacing trip plan may designate one or more operational settings of the vehicle system as a function of time, distance, and/or location. The pacing trip plan may be created and/or adjusted to direct the vehicle system to reach one or more of the plural waypoint locations within the corresponding target arrival time windows.

12 Claims, 7 Drawing Sheets

(56) References Cited

U.S. PATENT DOCUMENTS

| | | | | |
|---|---|---|---|---|
| 2009/0186325 | A1* | 7/2009 | Kumar | G09B 9/06 434/219 |
| 2009/0187291 | A1* | 7/2009 | Daum | B61L 15/0058 701/19 |
| 2009/0299555 | A1* | 12/2009 | Houpt | B61L 27/16 701/19 |
| 2013/0116916 | A1* | 5/2013 | Kickbusch | B61L 27/12 701/117 |
| 2013/0131909 | A1* | 5/2013 | Cooper | B61L 15/0058 701/70 |
| 2013/0144467 | A1* | 6/2013 | Kickbusch | G06Q 10/0631 701/2 |
| 2013/0158742 | A1* | 6/2013 | Cooper | B61L 27/16 701/2 |
| 2014/0136025 | A1* | 5/2014 | Cooper | B61L 27/12 701/2 |
| 2015/0232097 | A1* | 8/2015 | Luther | G01C 21/3415 701/1 |
| 2017/0282942 | A1* | 10/2017 | Mathews, Jr. | B61L 15/0062 |
| 2017/0299402 | A1* | 10/2017 | Hansen | H04W 4/024 |
| 2019/0367062 | A1* | 12/2019 | Brooks | B61L 27/12 |
| 2020/0051016 | A1* | 2/2020 | Briggs | G06Q 10/0832 |
| 2020/0272957 | A1* | 8/2020 | Lord | G06Q 50/40 |
| 2021/0080260 | A1* | 3/2021 | Tremblay | G01C 21/1656 |
| 2022/0379917 | A1* | 12/2022 | Henke | B60W 60/0015 |

* cited by examiner

VEHICLE CONTROL SYSTEM AND METHOD

CROSS-REFERENCE TO RELATED APPLICATIONS

The application claims priority to U.S. Provisional Application No. 63/391,117, filed on 21 Jul. 2022. The entirety of this application is incorporated herein by reference.

BACKGROUND

Technical Field

The subject matter described herein relates to systems and methods for controlling propulsion-generating vehicles.

Discussion of Art

Vehicle systems may move along a route according to a trip plan that factors various objectives, such as reducing travel time, reducing fuel consumption, reducing emissions, or the like, while satisfying designated constraints such as upper speed limits. Traveling according to a trip plan, however, may cause the vehicle system to creep up on another slower-moving vehicle system ahead of the trailing vehicle system. If the trailing vehicle system gets too close to the slower-moving vehicle system ahead, the trailing vehicle system may be required to slow and/or stop for a designated period of time in order to avoid the risk of an accident between the two vehicles. The slowing and/or stopping is undesirable because such a stop may result in a delay that frustrates the trailing vehicle system to satisfy various objectives, such as reducing travel time, reducing fuel economy, arriving at a destination at or before a prescribed arrival time, or the like. Furthermore, having to stop indicates that the trailing vehicle system could have reduced speed during an earlier segment of the trip, which could have resulted in fuel savings while arriving at a destination at a similar time as the trailing vehicle system traveling faster but having to stop. Due to required slow orders or stops every time the trailing vehicle approaches the vehicle system ahead, the trailing vehicle may move along the route in an undesirable "hurry up and wait" manner.

A need exists for a system and method that allows for creation and/or adjustments to a pacing trip plan designating power settings of a vehicle system that addresses the shortcomings of currently known systems and methods.

BRIEF DESCRIPTION

In accordance with one aspect or example, a vehicle control system may include one or more processors that may receive a data set associated with plural waypoint locations along one or more routes. The data set may indicate plural waypoint locations, target arrival time windows for a vehicle system to reach the plural waypoint locations, and priority ranks of the plural waypoint locations. The processors may create and/or adjust a pacing trip plan based on the data set. The pacing trip plan may designate one or more operational settings of the vehicle system as a function of time, distance, and/or location. The pacing trip plan may be created and/or adjusted to direct the vehicle system to reach one or more of the plural waypoint locations within the corresponding target arrival time windows.

In accordance with one aspect or example, a method may include receiving a data set associated with plural waypoint locations along one or more routes. The data set may indicate the plural waypoint locations, target arrival time ranges for a vehicle system to reach the plural waypoint locations, and priority ranks of the plural waypoint locations. A pacing trip plan may be created and/or adjusted based on the data set. The pacing trip plan may designate one or more operational settings of the vehicle system as a function of one or more of time, distance, or location. The pacing trip plan may be created and/or adjusted to direct the vehicle system to reach one or more of the plural waypoint locations within the corresponding target arrival time ranges.

In accordance with one aspect or example, a system may include an energy management system that includes one or more processors that may receive a data set associated with plural waypoint locations along a route. The data set may indicate the plural waypoint locations, target arrival time windows for a vehicle system to reach the plural waypoint locations, and priority ranks between the plural waypoint locations. The energy management system may create a pacing trip plan based on the data set and the priority ranks between the plural waypoint locations. The pacing trip plan may designate one or more operational settings of the vehicle system as a function of one or more of time, distance, or location. The pacing trip plan may be created to direct the vehicle system to reach one or more of the plural waypoint locations within the corresponding target arrival time windows.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to vehicle control systems and methods. In some embodiments, the vehicle system may be a controlled to be operated according to a pacing trip plan. Operating according to the pacing trip plan instead of being operated according to a non-pacing trip plan may reduce fuel consumption, reduce a hurry-up-and-wait time of travel, reduce wear on the vehicle system, increase throughput on a vehicle network, reduce emissions, reduce noise levels, or the like.

In some embodiments, the pacing trip plan may be created and/or adjusted based on a data set associated with plural waypoint locations along one or more routes. The data set may indicate the plural waypoint locations, target arrival time windows for the vehicle system to reach the plural waypoint locations, and priority ranks of the plural waypoint locations. The pacing trip plan may designate operations settings of the vehicle system as a function of time, distance, and/or location. Operating the vehicle system according to the pacing trip plan directs the vehicle system to reach one or more of the plural waypoint locations within the corresponding target arrival time windows.

Figure 1:
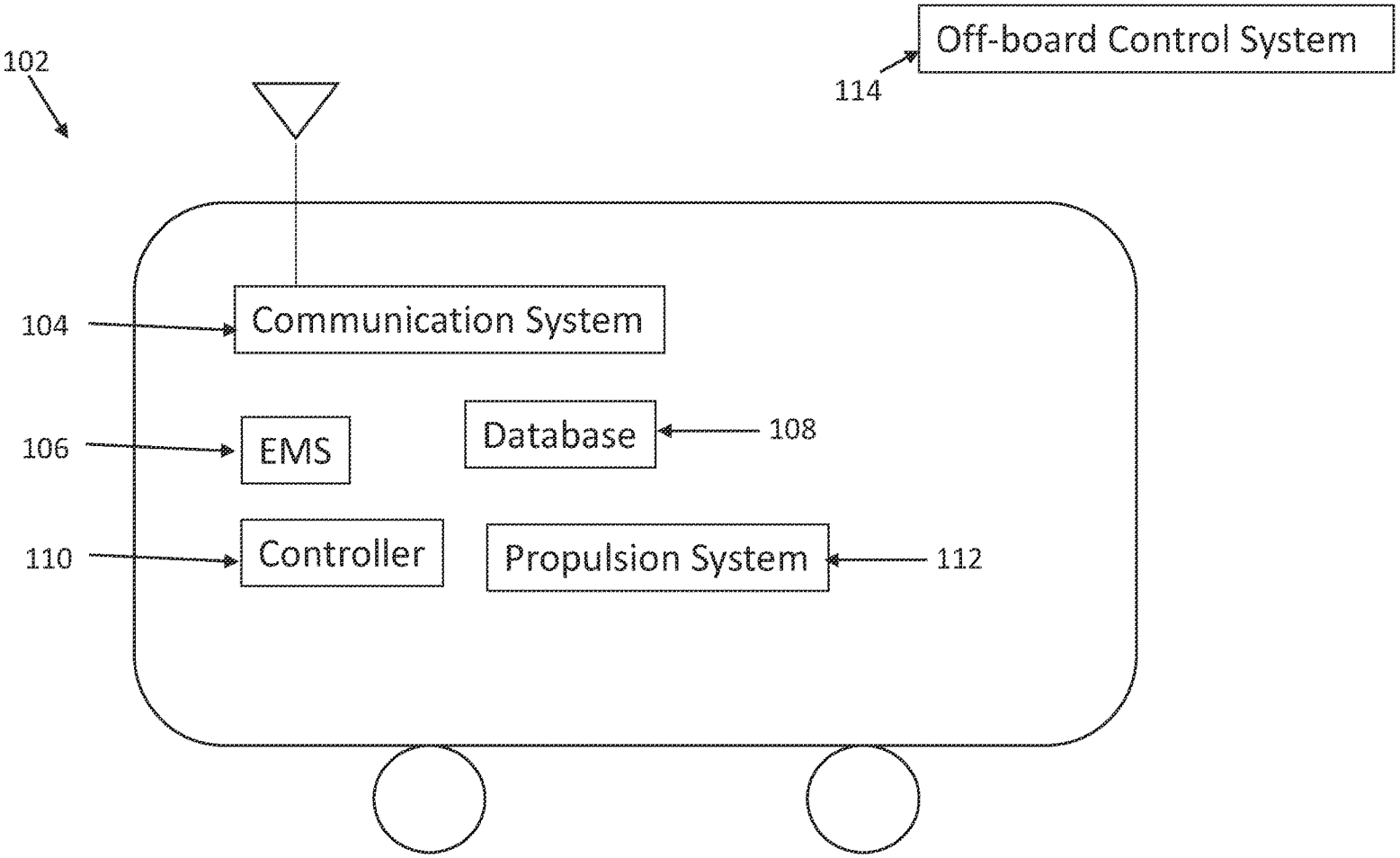
FIG. 1 illustrates one example of a vehicle system in accordance with one embodiment.

FIG. 1 illustrates one example of a vehicle system 102. In the illustrated embodiment, the vehicle system consists of a single vehicle, but alternatively may include two or more vehicles forming a multi-vehicle system including one or more propulsion-generating vehicles and/or one or more non-propulsion generating vehicles. In the illustrated embodiment, the vehicle system is a single propulsion-generating vehicle, such as a locomotive, but alternatively, the vehicle system may not be rail vehicles. For example, the vehicle system may be automobiles, trucks (with or without trailers), buses, aircraft (e.g., fixed wing, drones, rotary wing, etc.), mining vehicles, agricultural vehicles, marine vessels, or the like. In one or more embodiments of a multi-vehicle system, two or more vehicles may be mechanically coupled with each other (e.g., by couplers), or can be logically coupled without being mechanically coupled. For example, vehicles may be logically but not mechanically coupled when the separate vehicles communicate with each other to coordinate movements of the vehicles with each other so that the vehicles travel together (e.g., as a convoy, swarm, platoon, fleet, or the like).

In the illustrated embodiment, the vehicle system may be referred to as a lead vehicle of a multi-vehicle system, as this vehicle system controls or directs the operational settings of remote vehicle systems of the multi-vehicle system to control movement of the multi-vehicle system. In one or more embodiments, the lead vehicle may issue commands via control signals that are directly or indirectly communicated (wirelessly and/or wired communication) to other remote vehicles of the multi-vehicle system. The lead vehicle system may generate or create the control signals (such as via an energy management system of the lead vehicle) that are communicated to the other propulsion-generating vehicles of the multi-vehicle system.

Optionally, the lead vehicle, and/or the other propulsion-generating vehicle may receive control signals from an off-board control system 114. The off-board control system can represent hardware circuitry that includes or is connected with one or more processors (e.g., one or more integrated circuits, field programmable gate arrays, microprocessors, or the like), that perform one or more of the operations described herein. In one embodiment, the off-board control system may communicate the control signals to the lead propulsion-generating vehicle, and the lead propulsion-generating vehicle may relay (the same control signals or modified control signals) to each of the other propulsion-generating vehicles. In another embodiment, the off-board control system may communicate control signals to each of the propulsion-generating vehicles of the vehicle system.

The control signals may dictate operational settings of the propulsion-generating vehicles as a function of time, distance, and/or location (e.g., to reduce consumed fuel, generated emissions, generated noise, or the like). The operational settings may be automatically and/or manually designated as a function of time, distance, and/or location to operate the vehicle system according to a trip plan. The trip plan may be predetermined trip plan (e.g., determined prior to the vehicle system starting the move along the route) and/or the trip plan may be created and/or adjusted while the vehicle system moves along the route.

For example, the operational settings may be determined based on the trip plan for the vehicle system to move along a route between one or more locations. A vehicle system operating according to the trip plan may consume less fuel, may have a reduced travel time, may reduce an amount of wear on the vehicle system, may increase a throughput on a vehicle network, may reduce pollutant emissions, or may reduce noise emissions relative to a vehicle system that is not controlled according to the trip plan along the route. In one or more embodiments, the off-board control system may communicate the control signals indicating the operational settings of the trip plan before the vehicle system embarks on a trip along the route. In another embodiment, the off-board control system may communicate control signals indicating a change in the trip plan while the vehicle system is moving along the route. In another embodiment, the off-board control system may communicate control signals indicating a change in the trip plan after the vehicle system has started a trip, but while the vehicle system is stopped (e.g., at a waypoint location between a starting location and a destination), or the like.

In one or more embodiments, the trip plan may include operational settings dictating distributed power (DP) control that may be used to control multiple propulsion-generating vehicles distributed throughout the length of the vehicle system and an amount of effort provided by each of the propulsion-generating vehicles. The efforts may be braking efforts, tractive efforts, or a combination of the two. For example, in a multi-vehicle system, the lead vehicle may be directed to operate according to first operating settings at a first location to contribute a first amount of effort, and a remote propulsion-generating vehicle (not shown) may be directed to operate according to second operating settings (that may be different than or the same as the first operating settings) at the first location to contribute a second amount of effort. In one or more embodiments, the operational settings of each of the different propulsion-generating vehicles (e.g., of a multi-vehicle system) may control efforts provided by each of the propulsion-generating vehicles to control movement of the vehicle system and to propel the vehicle system to move along the route.

The operational settings of the propulsion-generating vehicles may be determined based on the time, distance, and/or location of the vehicles to coordinate the efforts provided by each of the vehicles at the different times, distances, and/or locations along the route. For example, the lead propulsion-generating vehicle may be operated to contribute a first amount of effort (e.g., tractive effort), and the remote propulsion-generating vehicle may be operated to contribute a different, second amount of effort (e.g., tractive effort) at a location along the route. The different contributions of efforts may be to control one or more performance variables of the vehicle system. The performance variables may include, but are not limited to, forces between adjacent vehicles of the vehicle system (e.g., tension forces, compression forces, or the like), forces on couplers between the adjacent vehicles, states of different couplers between adjacent vehicles (e.g., a health state of the couplers, an amount of wear, an age of the couplers, or the like), a state of charge of an energy storage device of the vehicle system (e.g., a battery, or the like), or the like.

The vehicle system includes a controller 110 that represents hardware circuitry that includes or is connected with one or more processors (e.g., one or more integrated circuits, field programmable gate arrays, microprocessors, or the like) that perform the operations described herein. The vehicle system includes a communication system 104 that represents transceiving hardware (e.g., antennas, wires, cables, modems, codecs, or the like) that wirelessly communicate the signals or communicate the signals described herein via wired connections with the off-board control system, other vehicles of the multi-vehicle system, other remote vehicle systems, wayside devices or dispatch centers, or the like.

In one or more embodiments, the controller of the vehicle system may receive control signal (e.g., from the off-board control system) via the communication system. In response to receiving the control signal or based on a received control signal, the controller can direct a propulsion system 112 of the vehicle system to generate tractive effort and/or braking effort according to the control signal. The propulsion system can represent one or more engines, alternators, generators, motors, or the like, that operate to propel the vehicle (and vehicle system) and/or brake the vehicle or vehicle system (e.g., using dynamic braking).

The vehicle system may include an energy management system (EMS) 106 that represents hardware circuitry that includes or is connected with one or more processors that determine operational settings of the vehicle system. For example, the energy management system can determine throttle settings, speeds, brake settings, accelerations, or the like, for different vehicles (e.g., of the multi-vehicle system) at different times, locations, distances, etc., to cause the vehicle system to arrive at a location within a scheduled time but while consuming less fuel, consuming less electric energy, generating less noise, and/or generating fewer emissions when compared to the same vehicle system arriving at the same location within the same scheduled time but using different operational settings. For example, the EMS may determine one or more operational settings for the vehicle system to operate according to the trip plan. Optionally, the EMS may receive control signals communicated by the off-board control system indicating the operational settings of the trip plan, and may determine the throttle and/or brake settings of the vehicle system in order to operate according to the trip plan communicated by the off-board control system. Optionally, the EMS may receive the trip plan from the off-board control system and may modify or change one or more of the operational settings received from the off-board control system (e.g., override and/or ignore the control signals from the off-board control system).

The energy management system (EMS) may store information or access information associated with a profile of the vehicle system from a database 108 to determine the operational settings. The profile can indicate or identify which propulsion-generating vehicles are in the multi-vehicle system, locations of the different propulsion-generating vehicles (e.g., relative to each other propulsion-generating vehicles, a geospatial location of the vehicles, or the like), locations of non-propulsion-generating vehicles, a weight of one or more of the vehicles, a combined weight of the vehicle system, or the like. While the database is illustrated to be onboard the vehicle system, optionally the database may be disposed off-board the vehicle system, such as a cloud-based data storage system, a database at a dispatch center, or the like.

Figure 2:
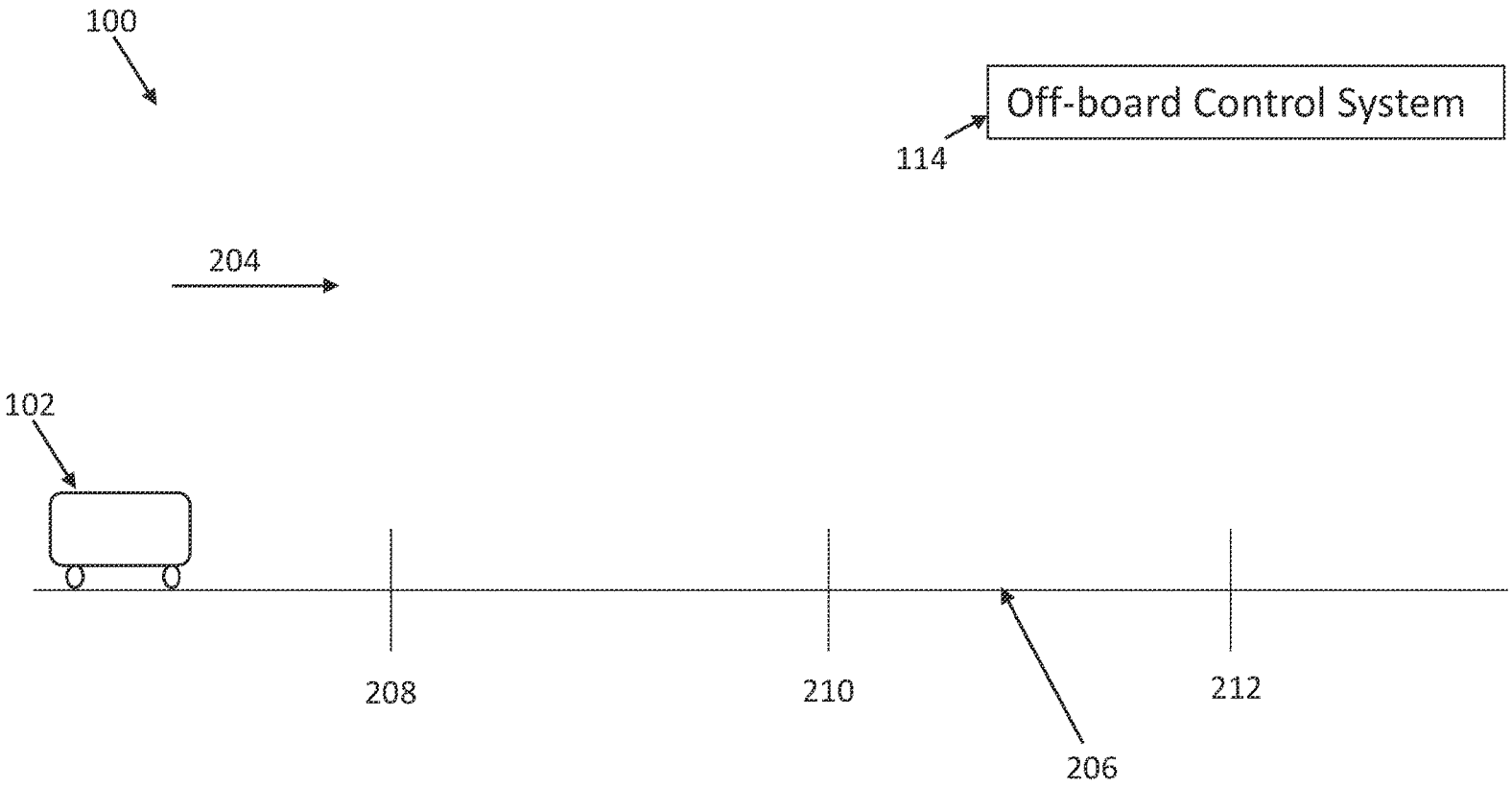
FIG. 2 illustrates a schematic of a vehicle control system controlling operation of a vehicle system according to a pacing trip plan in accordance with one embodiment.

FIG. 2 illustrates one embodiment of a schematic of a vehicle control system 100 controlling operation of the vehicle system along a route 206. The route may include plural waypoint locations disposed at locations along the route in a direction of travel 204 of the vehicle system. A first waypoint location 208 is disposed at a first location or distance along the route. A second waypoint location 210 is disposed at a second location or distance along the route that is past the first waypoint location in the direction of travel of the vehicle system. A third waypoint location 212 is disposed at a third location or distance along the route that is past the first and second waypoint locations in the direction of travel of the vehicle system. The geographic locations or positions of the waypoint locations may be the same or may vary for different vehicle systems that move along the route, and are for illustrative purposes only. Prior to the vehicle system moving along the route, the controller of the vehicle system may generate and/or receive a data set (e.g., from the off-board control system) associated with the trip. The data set may include operational settings indicating throttle and/or brake settings at different locations along the route (e.g., relative to the waypoint locations, relative to other geospatial designated locations, or the like).

The data set may also include information associated with each of the plural waypoint locations such as, but not limited to, geospatial information, distances between adjacent and/or non-adjacent waypoint locations, other vehicle and/or pedestrian population details associated with the waypoint locations, vehicle network details such as different routes interconnected at the different waypoint locations, fuel availability at the waypoint locations, or the like.

Additionally, the data set may include target arrival times, or arrival time windows or time ranges, at which the vehicle system is to reach each of the different waypoint locations. The target arrival time may fall within the arrival time window or time range. In one embodiment, the target arrival time windows or ranges may be about 1 minute long, about 30 minutes long, about 1 hour long, about 5 hours long, about 24 hours long, or the like. Optionally, the target arrival time windows or ranges may be based on the time of day the vehicle system is anticipating to reach the waypoint location (e.g., within or outside of daylight hours), may be based on the day of the week at which the vehicle system is expected to reach a waypoint location (e.g., a business day or a weekend day), or the like. In one embodiment, the target arrival time window for each waypoint location may be designated by an owner of the vehicle system, an owner of cargo being carried by the vehicle system, an operator of the vehicle system, a remote dispatcher, or the like.

The data set may also indicate a priority rank of each of the plural waypoint locations relative to the other waypoint locations the vehicle system will reach along the route. For example, each of the plural waypoint locations may be known or understood, and each of the plural waypoint locations may be given a priority or ranking relative to each other waypoint location. In one embodiment, the priority ranking may be designated by an owner of the vehicle system, an owner of cargo being carried by the vehicle system, an operator of the vehicle system, a remote dispatcher, or the like.

The priority ranking may indicate which waypoint location is more important (e.g., to reach the more important waypoint location at the target arrival time or within the target arrival time window) relative to the other waypoint locations. For example, the operator of the vehicle system may indicate that it is more important to reach the second waypoint location at the target arrival time or within the target arrival time window of the second waypoint location than it is to reach the first waypoint location at the target arrival time or within the target arrival time window of the first waypoint location.

In one or more embodiments, the off-board control system and/or the EMS of the vehicle system may create or adjust a pacing trip plan based on the data set associated with the plural waypoint locations (e.g., each waypoint location, target arrival time windows for the vehicle system to reach the plural waypoint locations, and the priority ranks between the plural waypoint locations). The pacing trip plan may include operational settings at which the vehicle system is to operate at different locations along the route. One or more operational settings of the pacing trip plan may vary or differ from operational settings of the original trip plan.

In one embodiment, the vehicle system may create and/or receive the original trip plan indicating operational settings at which the vehicle system is to operate as the vehicle system moves along the route. Additionally, the vehicle system may create, receive, and/or adjust the pacing trip plan. The off-board control system and/or the vehicle system may compare the original trip plan with the pacing trip plan, and may determine that the vehicle system is to be controlled to operate according to the pacing trip plan instead of the original trip plan, such as at one or more different locations along the route. For example, the vehicle system may determine to operate according to the operational settings of the pacing trip plan instead of the operational settings of the original trip plan. Operating according to the pacing trip plan (instead of the original trip plan) may reduce fuel consumption, may reduce an amount or level of wear on the vehicle system, may increase a throughput on a vehicle network, may reduce pollutant emissions, may reduce noise emissions, or the like, relative to the vehicle system operating according to the original trip plan.

In one or more embodiments, the vehicle system operating according to the pacing trip plan (e.g., instead of the original trip plan) may have an increased travel time. Alternatively, the increased travel time may reduce an amount of time that the vehicle system needs to slow and/or stop and wait. For example, the vehicle system operating according to the original trip plan may travel at an increased travel time (relative to the pacing trip plan), but may have to slow and/or stop movement to wait, such as due to another vehicle system moving ahead of the vehicle system, another vehicle system needing to cross the route at an intersection ahead of the vehicle system, a schedule of one or more traffic control devices (e.g., lights, signs, intersections, or the like), or the like. The vehicle system may have a reduced hurry-up-and-wait travel time relative to the vehicle system operating according to the original trip plan. For example, the original trip plan may cause the vehicle system to have to wait for a longer period of time relative to the vehicle system operating according to the pacing trip plan. In one or more embodiments, operating according to the original trip plan may cause increase the amount of time the vehicle system needs to slow or stop movement, and subsequently restart moving along the route. Starting movement from a stopped position, or increasing speeds from a decreased speed, may require additional time, relative to the vehicle system operating according to the pacing trip plan where the vehicle system may stop at fewer locations along the route.

Figure 3:
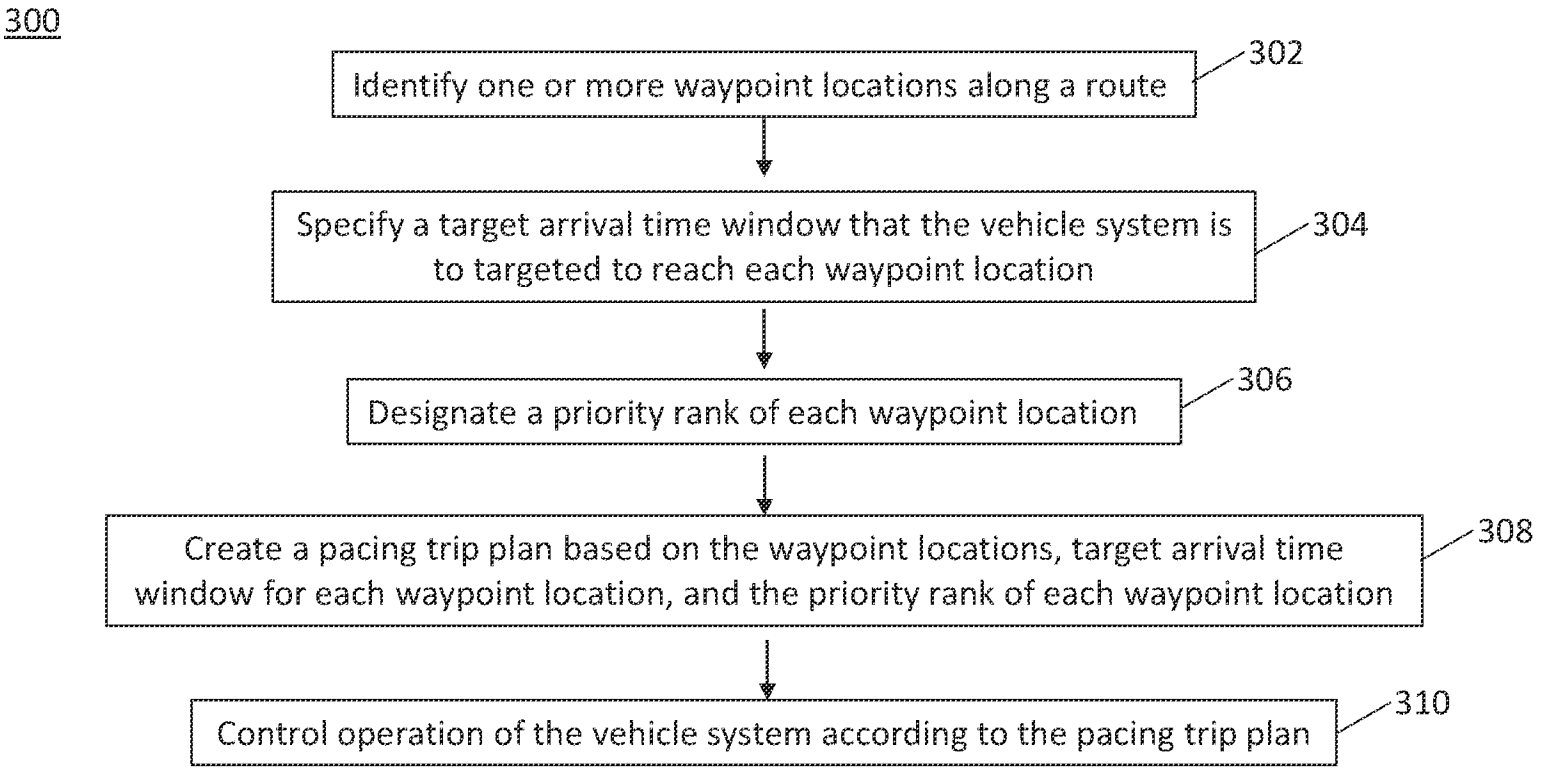
FIG. 3 illustrates a flowchart of one example of a method for controlling operation of a vehicle system in accordance with one embodiment.

FIG. 3 illustrates a flowchart 300 of one example of a method for controlling operation of a vehicle system in accordance with one embodiment. At step 302, one or more waypoint locations along a route may be identified. In one embodiment, the waypoint locations may represent one or more of route intersections within a network of intersecting routes, locations where the vehicle system may receive fuel or another power source (e.g., a charging station), locations where cargo may be loaded onto and/or unloaded from the vehicle system, may be predetermined distances apart from each other and between a starting location and final destination (e.g., about every 20 miles, about every 100 miles, or the like), may be locations where additional vehicles may join and/or disconnect or decouple from the multi-vehicle system, or the like.

In one or more embodiments, the number of waypoint locations may be based on a distance between a starting location and a destination of the vehicle system. Optionally, the number of waypoint locations may be based on the different environments in which the vehicle system will move between the starting location and the destination. For example, a vehicle system moving through a largely populated area or an area with a determined number of route intersections may have a number of identified waypoint locations that is greater than a vehicle system moving through a less populated area or an area with fewer route intersections. Optionally, the number of waypoint locations may be based on a priority or level of importance of the vehicle system, such as relative to a priority or level of importance of other vehicle systems moving within the same route network, such as on other intersecting routes. Optionally, the number of waypoint locations may be based on the type of cargo being carried (e.g., consumable goods, passengers, hazmat materials, or the like).

In one or more embodiments, one or more of the waypoint locations may be designated by the off-board control system. Optionally, an owner of the vehicle system, an operator of the vehicle system, an owner of the cargo being carried (or that will be carried) by the vehicle system, or the like, may designate one or more of the waypoint locations. The one or more waypoint locations may be identified prior to the vehicle system moving along the route toward the waypoint locations. Optionally, one or more waypoint locations may be identified after the vehicle system starts moving along the route, but before the vehicle system reaches the originally unidentified waypoint location or before the vehicle system reaches a threshold distance from the waypoint location. For example, a new waypoint location may be identified prior to the vehicle system being within about 100 yards of the new waypoint location, or the like.

At step 304, a target arrival time or target arrival time window or range is specified for each waypoint location. For example, the identity of each waypoint location may include a target arrival time window at which the vehicle system is requested to arrive within at the corresponding waypoint location. The target arrival time windows may have ranges of about 5 minutes, about 30 minutes, about 5 hours, about 24 hours, or the like. One or more of the waypoint locations may have about the same or substantially the same length of arrival time window, or optionally one or more waypoint location may have an arrival time window range that is different than an arrival time window range of another waypoint location. For example, a first waypoint location may have an arrival time window range that is about 1 hour in length of time, and a second waypoint location may have an arrival time window range is about 30 minutes in length of time.

At step 306, a priority rank of each waypoint location is designated. In one embodiment, the designation of the priority rank of each waypoint location may be designated by an owner of the vehicle system, an owner of cargo being carried by the vehicle system, an operator of the vehicle system, a manually and/or automated scheduling system (e.g., such as at the off-board control system or another dispatch center), or the like. The priority rank may include each of the plural waypoint locations, and may indicate an order of priority of each of the plural waypoint locations. For example, the route may include first, second, and third waypoint locations, and the priority rank may indicate which of the first, second, and third waypoint locations is most important, is second in importance, and which is least important.

At step 308, a pacing trip plan may be created and/or adjusted based on the one or more waypoint locations, the target arrival time window for each waypoint location, and the priority rank of each waypoint location. In one or more embodiments, the controller of the vehicle system may receive the information associated with the waypoint locations, the target arrival time windows, and the priority rank, and may automatically create the pacing trip plan, or adjust an existing pacing trip plan. In another embodiment, the off-board control system may receive the information associated with the waypoint locations, the target arrival time windows, and the priority rank, and may automatically create the pacing trip plan, or adjust an existing pacing trip plan, and communicate the pacing trip plan with the onboard controller. In one or more embodiments, the off-board control system may automatically (or manually) create the pacing trip plan, and may communicate control signals to the vehicle system to automatically control operation of the vehicle system based on the pacing trip plan, to instruct an operator of the vehicle system how to manually control operation of the vehicle system based on the pacing trip plan, or the like.

In one or more embodiments, the user-specified target arrival time windows may be determined or specified without consideration of the vehicle system make-up, speed limit considerations (e.g., maximum and/or minimum speed limits), emission limit considerations, network traffic considerations, or the like, and therefore the vehicle system may be incapable of reaching one or more waypoint locations within the corresponding target arrival time window. For example, the owner of the vehicle system may indicate that a first waypoint location has a first target arrival time window, and a second waypoint location, at a second location along the route in the direction of movement of the vehicle system, has a second target arrival time window that is at a time before the first target arrival time window.

The vehicle system may be incapable of arriving at the second waypoint location within the second target arrival time window if the vehicle system arrived at the first waypoint location within the first target arrival time window. For example, the vehicle system is unable to be at two locations at the same time. The priority rank of each waypoint location may allow for the creation or adjustment of the pacing trip plan to ensure that the vehicle system reaches the waypoint location with the highest or greatest priority rank within the corresponding target arrival time window. Arriving at the waypoint location with the highest or greatest priority rank, however, may cause the vehicle system to reach other waypoint locations (e.g., ahead of or before the highest priority waypoint location in the direction of travel of the vehicle system) with lower priority ranks at times outside of the corresponding arrival time windows. For example, controlling the vehicle system according to the pacing trip plan may ensure that the vehicle system reaches a second waypoint location (e.g., with the highest priority rank) within the corresponding target arrival time window, but may cause the vehicle system to reach the first waypoint location (e.g., at a location before or upstream of the second waypoint location in the direction of movement of the vehicle system) outside of the corresponding target arrival time window. For example, the vehicle system may reach the first waypoint location before or after the corresponding first target arrival time window. Additionally, arriving at the second waypoint location may cause the vehicle system to reach a third waypoint location (e.g., at a location after or downstream from the second waypoint location in the direction of movement of the vehicle system) outside of the corresponding target arrival time window. For example, the vehicle system may reach the third waypoint location before or after the corresponding third target arrival time window.

Figure 4:
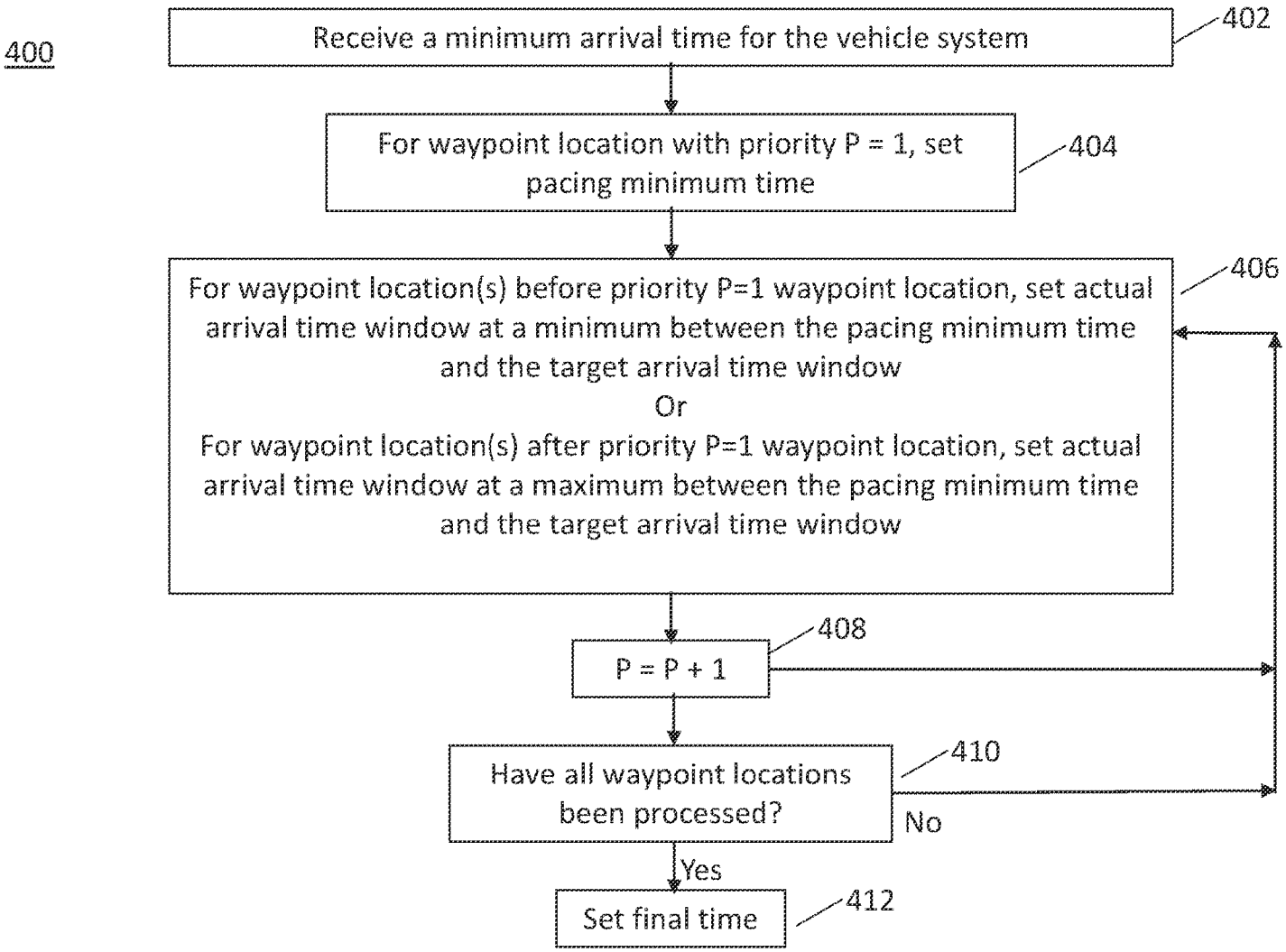
FIG. 4 illustrates a flowchart of one example of a method for creating or adjusting a pacing trip plan for controlling operation of a vehicle system in accordance with one embodiment

FIG. 4 illustrates a flowchart 400 of one example of a method for creating or adjusting a pacing trip plan of a vehicle system in accordance with one embodiment. The graph may represent one method of an algorithm for creating and/or adjusting the pacing trip plan. Optionally, other mathematical simulations may be used to create and/or adjust the pacing trip plan.

Figure 5:
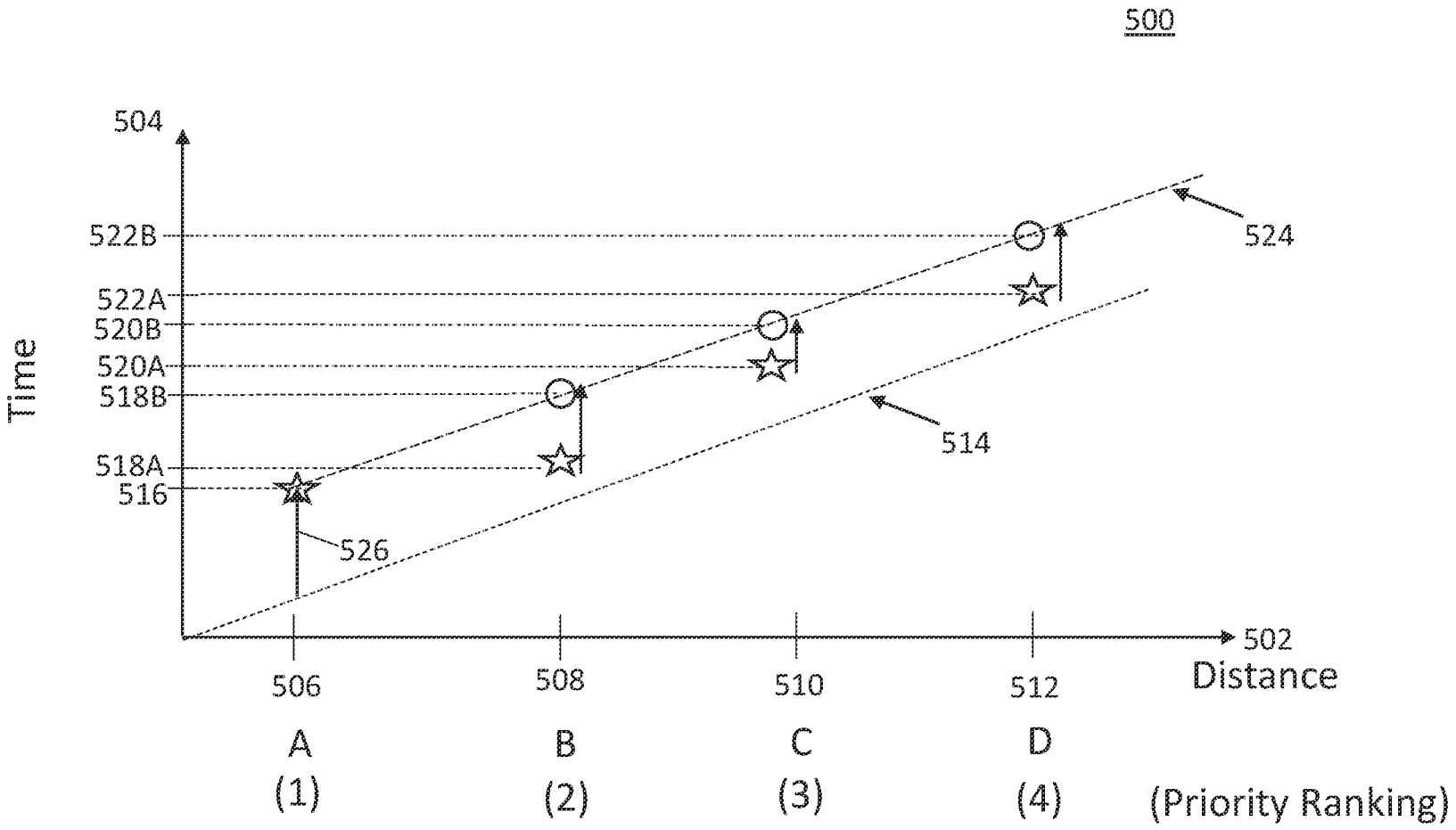
FIG. 5 illustrates a graph of a first example of a pacing trip plan in accordance with one embodiment.

FIG. 5 illustrates a graph 500 of one example of a pacing trip plan for a vehicle system based on a first example of a priority ranking in accordance one embodiment. FIGS. 4 and 5 will be discussed together herein. The graph 500 shown in FIG. 5 includes a horizontal axis 502 representative of distance, and a vertical axis representative 504 of time. The graph includes a waypoint location A (506), a second waypoint location B (508), a third waypoint location C (510), and a fourth waypoint location D (512). The vehicle system is expected to move through the first, second, third, and fourth waypoint locations in the direction of travel of the vehicle system between a start location and a destination location.

At step 402, a minimum arrival time for a vehicle system is received. For example, a line 514 shown in graph 500 indicates an original minimum time of arrival for the vehicle system. The original minimum time of arrival may be an expected time of arrival of the vehicle system if the vehicle system moves at the fastest speed the vehicle system is allowed and/or capable of moving. For example, the original minimum time of arrival may be based on maximum and/or minimum speed restrictions (e.g., governmental restrictions) at one or more locations along the route, speed and/or power capabilities of the vehicle system, or the like. The original minimum time of arrival may represent the optimal, ideal, or shortest time of travel of the vehicle system between a starting location and destination, such as without planned and/or unplanned stops, without unplanned speed reductions (e.g., based on other vehicle systems being on the route ahead of the vehicle system, based on other vehicles or pedestrians crossing the route, or the like), or the like.

At step 404, the waypoint location with the highest or greatest priority rank is identified, and the pacing minimum time may be set to ensure that the vehicle system reaches the waypoint location with the highest priority rank within the corresponding target arrival time window. For example, with reference to the graph shown in FIG. 5, the first waypoint location A has the greatest or highest priority rank, the second waypoint location has the second highest priority rank, the third waypoint location has the third highest priority rank, and the fourth waypoint location has the lowest priority rank.

The first waypoint location (e.g., the waypoint location having the greatest or highest priority rank relative to the other waypoint locations) has a first target arrival time window 516. In order to ensure that the vehicle system reaches the first waypoint location within the first target arrival time window, the pacing trip plan may be created to ensure that the vehicle system is controlled (e.g., speed and/or brake settings may be adjusted) to reach the first waypoint location within the first target arrival time window.

For example, a pacing line 524 indicates an adjusted minimum arrival time that includes an increase 526 in time from the original minimum time of arrival. For example, the vehicle system operating according to the pacing trip plan based on the adjusted minimum arrival time ensures that the vehicle system moves at speeds that are less than a maximum speed limit (e.g., the original minimum time of arrival 514) and/or speeds that are greater than a minimum speed limit.

Returning to FIG. 4, at step 406, actual arrival time windows may be determined for waypoint locations located before (e.g., upstream from) and/or after (e.g., downstream from the waypoint location with the highest priority. For waypoint locations upstream or before the waypoint location with the highest priority rank, an actual arrival time window is determined as a minimum between two values (e.g., the adjusted minimum arrival time, e.g., the pacing line 524, and the target arrival time window of the corresponding waypoint location). For waypoint locations downstream or after the waypoint location with the highest priority rank, an actual arrival time window is determined as a maximum between two values (e.g., the adjusted minimum arrival time, e.g., pacing line 524, and the target arrival time window of the corresponding waypoint location).

The second waypoint location has a second target arrival time window 518A, but it is infeasible for the vehicle system to reach the second waypoint location within the second target arrival time window. For example, the second waypoint location has a priority that is less than a priority of the first waypoint location. The pacing trip plan designates one or more operational settings of the vehicle system to ensure that the vehicle system reaches the first waypoint location within the first target arrival time window, but the vehicle system operating according to the pacing trip plan causes the vehicle system to reach the second waypoint location at a time that is outside of the second target arrival time window. The vehicle system will actually arrive at the second waypoint location at a time after or later than the second target arrival time window. For example, it is determined that the vehicle system will arrive at the second waypoint location within a second actual arrival time window 518B (e.g., the maximum between the adjusted minimum arrival time, pacing line 524, and the second target arrival time window), while the vehicle system operates according to the pacing trip plan. The second actual arrival time window for the second waypoint location of the pacing trip plan needs to increase or move up to the adjusted minimum arrival time.

The third waypoint location is downstream from the first waypoint location, and has the second highest priority rank. The third waypoint location has a third target arrival time window 520A. The vehicle system will actually arrive at the third waypoint location at a time after or later than the third target arrival time window. For example, the third waypoint location has a priority that is less than a priority of the first and second waypoint locations. The pacing trip plan designates one or more operational settings of the vehicle system to ensure that the vehicle system reaches the first waypoint location within the first target arrival time window, but the vehicle system operating according to the pacing trip plan causes the vehicle system to reach the third waypoint location at a time that is outside of the third target arrival time window. For example, it is determined that the vehicle system will arrive at the third waypoint location within a third actual arrival time window 520B (e.g., the maximum between the adjusted minimum arrival time, pacing line 524, and the third target arrival time window), while the vehicle system operates according to the pacing trip plan. The third actual arrival time window for the third waypoint location of the pacing trip plan needs to increase or move up to the adjusted minimum arrival time.

The fourth waypoint location is downstream from the first waypoint location, and has the lowest priority rank of the plural waypoint locations. The fourth waypoint location has a fourth target arrival time window 522A. The vehicle system will actually arrive at the fourth waypoint location at a time that is after or later than the fourth target arrival time window. For example, it may be determined that the vehicle system will arrive at the fourth waypoint location within a fourth actual arrival time window 522B (e.g., the maximum between the adjusted minimum arrival time, pacing line 524, and the third target arrival time window), while the vehicle system operates according to the pacing trip plan. The fourth actual arrival time window for the fourth waypoint location of the pacing trip plan needs to increase or move up to the adjusted minimum arrival time.

Returning to FIG. 4, at step 408, the next highest priority rank waypoint location is considered, and the algorithm repeats. For example, in the illustrated example of Figure the second waypoint location has the second highest priority rank. For waypoint location(s) located downstream or before the second waypoint location, the actual arrival time window is set at a minimum between the adjusted minimum arrival time (e.g., pacing line 524) and the target arrival time window. Alternatively, for waypoint location(s) located upstream or after the second waypoint location, the actual arrival time window is set at a maximum between the adjusted minimum arrival time (e.g., pacing line 524) and the target arrival time window. For example, the first actual arrival time window for the first waypoint location (e.g., located upstream of the second waypoint location) is adjusted based on the adjusted minimum arrival time. The third actual arrival time window for the third waypoint location (e.g., located downstream of the second waypoint location), remains adjusted based on the adjusted minimum arrival time. Additionally, the fourth actual arrival time window for the fourth waypoint location (e.g., located downstream of the second waypoint location), remains adjusted based on the actual minimum arrival time.

The algorithm may repeat for the next highest priority rank waypoint location (e.g., the third waypoint location), and the actual arrival time windows for the other waypoint locations may be adjusted or may remain as previously adjusted. The algorithm may continue to repeat for the each waypoint location, and the actual arrival time windows may be adjusted or may remain as previously adjusted.

At step 410, a determination is made whether all waypoint locations have been processed and assessed. If one or more waypoint locations have not been processed, then the method returns to step 406 and the algorithm continues. Alternatively, if all waypoint locations have been processed, flow of the method proceeds toward step 412, where the final time is set and the pacing trip plan is created. In one or more embodiments, the final time may also include and/or consider additional or alternative delays in the vehicle system reaching the final destination.

Returning to FIG. 3, at step 308 the pacing trip plan may be created for the vehicle system based on the example algorithm illustrated in FIGS. 4 and 5. In one or more embodiments, the pacing trip plan may be created or adjusted to reduce a number of stops that the vehicle system makes along the route, relative to the vehicle system operating according to the original trip plan. For example, the pacing trip plan may be created based on movement of a second vehicle system (not shown) moving along the same route as the vehicle system (e.g., the first vehicle system). The second vehicle system may be ahead of or behind the first vehicle system, and moving in the same direction of movement as the first vehicle system. The pacing trip plan may be created for the first vehicle system to maintain a designated spacing apart from the second vehicle system along the route.

At step 310, operation of the vehicle system may be controlled (e.g., automatically by the onboard controller and/or the off-board control system, manually by an operator of the vehicle system, or the like) according to the pacing trip plan. The pacing trip plan may be created or adjusted to direct the vehicle system to reach one or more of the plural waypoint locations within the corresponding target arrival time windows.

In one or more embodiments, the pacing trip plan may be created before the vehicle system starts moving along the route. Optionally, the pacing trip plan may be created after the vehicle system has started moving along the route. For example, the vehicle system may be operated according to an original trip plan, but it may be determined that the vehicle system will creep up on another vehicle system ahead of the vehicle system in the direction of travel of the two vehicle systems. The pacing trip plan may be created while the vehicle system is moving, after the vehicle system has started moving along the route, or the like, in order to control a distance between the two vehicle systems. In another embodiment, the pacing trip plan may be created before the vehicle system starts moving along the route, but it may be determined, after the vehicle system has started moving according to the pacing trip plan, that the pacing trip plan needs to be adjusted or changed. For example, additional waypoint locations may be added to the data set used to create the trip plan, waypoint locations may be removed from the data set, the priority rank of the different waypoint locations may change, or the like.

Figure 6:
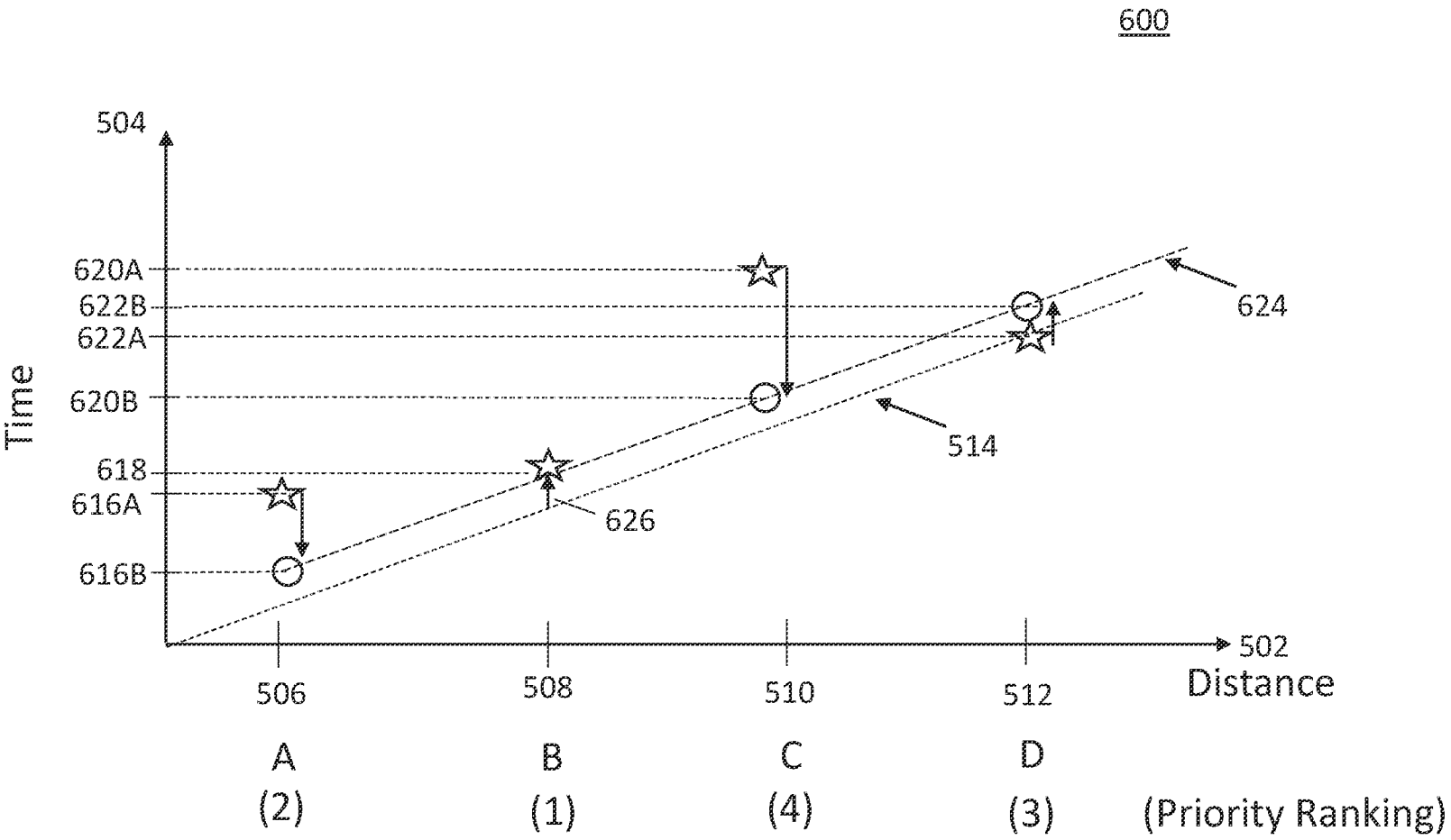
FIG. 6 illustrates a graph of a second example of a pacing trip plan in accordance with one embodiment.

FIG. 6 illustrates a graph 600 of a second example of a pacing trip plan for a vehicle system in accordance one embodiment. The graph includes the horizontal axis 502 and vertical axis 504 representative of distance and time, respectively, and first, second, third, and fourth waypoint locations A, B, C, D (506, 508, 510, 512), respectively. In the illustrated embodiment of FIG. 6, the second waypoint location B (510) has the highest priority rank, the first waypoint location A (506) has the second highest priority rank, the fourth waypoint location D (512) has the third highest priority rank, and the third waypoint location C (510) has the lowest priority rank. The graph also includes the line 514 indicating the original minimum time of arrival for the vehicle system.

Following the steps of the algorithm method shown in FIG. 4, the waypoint location with the highest priority rank is considered first. For example, the second waypoint location has been assigned or identified as having the highest priority rank relative to the other waypoint locations. The second waypoint location has a second target arrival time window 618. For P=1 (e.g., the second waypoint location), in order to ensure that the vehicle system reaches the second waypoint location within the second target arrival time window, the pacing trip plan may be created to ensure that the vehicle system reaches the second waypoint location within the second target arrival time window. For example, a pacing line 624 indicates an adjusted minimum arrival time that includes an increase 626 in time from the original minimum time of arrival (e.g., line 514). For example, the vehicle system will operate at a slower speed according to the pacing trip plan relative to a higher speed according to the original trip plan in order to reach the second waypoint location within the second target arrival time window.

The waypoint location with the second highest priority is the first waypoint location. The first waypoint location is located upstream or before the second waypoint location and has a first target arrival time window 616A. It is not feasible for the vehicle system to reach the first waypoint location within the first target arrival time window based on the vehicle system reaching the second waypoint location (e.g., with the highest priority rank) within the second target arrival time window. For example, the second waypoint location has a priority that is greater than a priority of the first waypoint location. The pacing trip plan designates one or more operational settings of the vehicle system to ensure that the vehicle system reaches the second waypoint location within the second target arrival time window, but the vehicle system operating according to the pacing trip plan causes the vehicle system to reach the first waypoint location at a time that is outside of the first target arrival time window. It is determined that the vehicle system will need to arrive at the first waypoint location within a first actual arrival time window 616B (e.g., the minimum value between the adjusted minimum arrival time, pacing line 624, and the first target arrival time window). For example, the vehicle system will actually arrive at the first waypoint location at a time earlier than the first target arrival time window while the vehicle system operates according to the pacing trip plan. The first actual arrival time window for the first waypoint location of the pacing trip plan needs to decrease or move down to the adjusted minimum arrival time (e.g., pacing line 624).

The waypoint location with the third highest priority is the fourth waypoint location. The fourth waypoint location is identified as having the third highest priority rank. The fourth waypoint location is located downstream or after the second waypoint location and has a fourth target arrival time window 622A. It is determined that it is not feasible for the vehicle system to reach the fourth waypoint location within the fourth target arrival time window based on the vehicle system reaching the second waypoint location (e.g., with the highest priority rank) within the second target arrival time window. Alternatively, it is determined that the vehicle system will need to arrive at the fourth waypoint location within a fourth actual arrival time window 622B (e.g., the maximum value between the adjusted minimum arrival time, pacing line 624, and the fourth target arrival time window). For example, the vehicle system will actually arrive at the fourth waypoint location at a time that is later than the fourth target arrival time window while the vehicle system operates according to the pacing trip plan. The fourth actual arrival time window for the fourth waypoint location of the pacing trip plan needs to increase or move up to the adjusted minimum arrival time (e.g., pacing line 624).

In the illustrated embodiment of FIG. 6, the third waypoint location has the lowest priority rank. The third waypoint location is located upstream or before the fourth waypoint location and has a third target arrival time window 620A. It is determined that it is not feasible for the vehicle system to reach the third waypoint location within the third target arrival time window based on the vehicle system reaching the fourth waypoint location (e.g., with the higher priority rank relative to the third waypoint location) within the fourth target arrival time window. Alternatively, it is determined that the vehicle system will need to arrive at the third waypoint location within a third actual arrival time window 620B (e.g., the minimum value between the adjusted minimum arrival time, pacing line 624, and the third target arrival time window). For example, the vehicle system will actually arrive at the third waypoint location at a time that is earlier than the third target arrival time window while the vehicle system operates according to the pacing trip plan. The third actual arrival time window for the third waypoint location of the pacing trip plan needs to decrease or move down to the adjusted minimum arrival time (e.g., pacing line 624).

Figure 7:
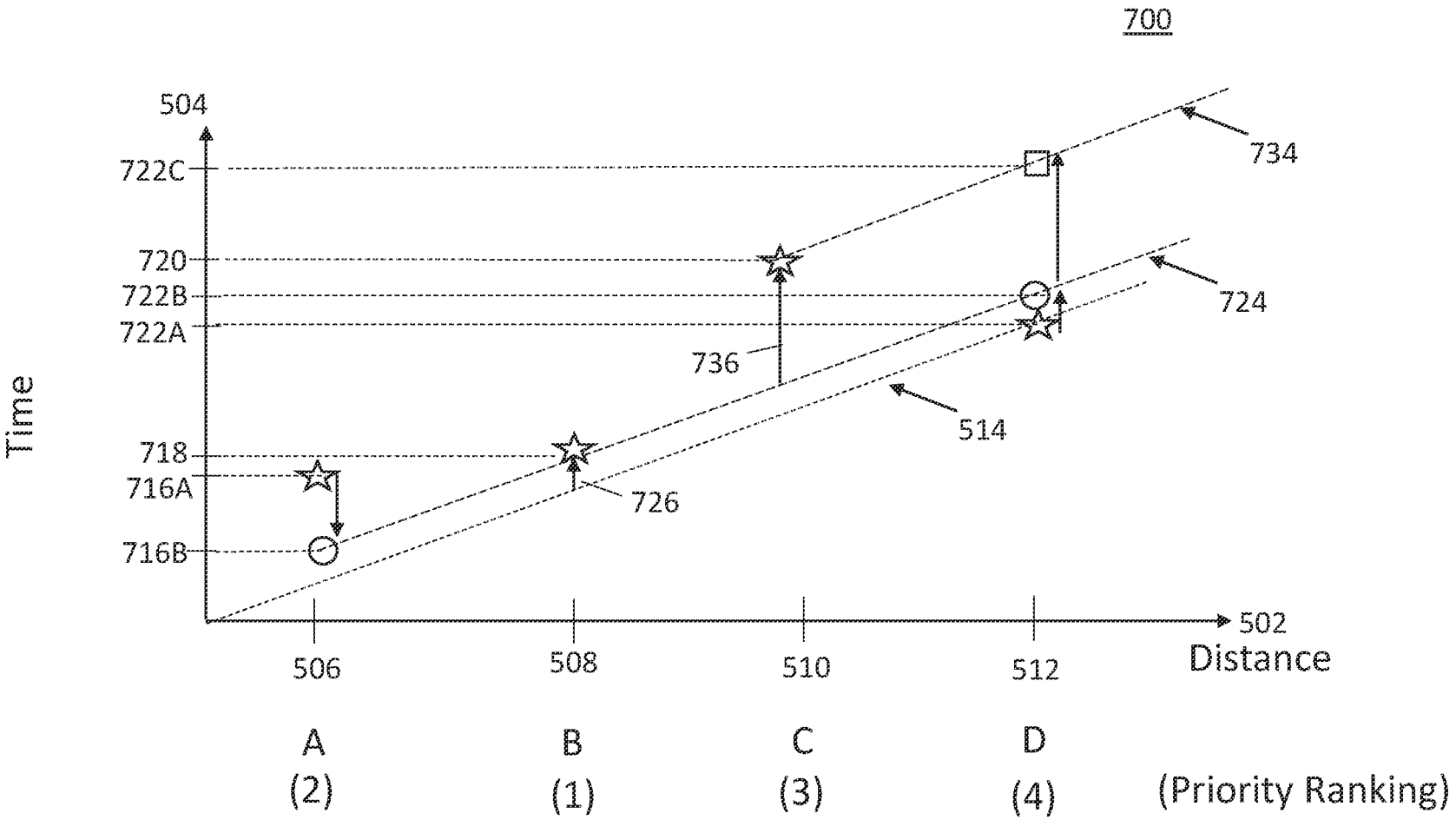
FIG. 7 illustrates a graph of a third example a pacing trip plan in accordance with one embodiment.

FIG. 7 illustrates a graph 700 of a third example of a pacing trip plan for a vehicle system in accordance with one embodiment. The graph includes the same horizontal axis 502 and vertical axis 504 representative of distance and time, respectively, and first, second, third, and fourth waypoint locations A, B, C, D (506, 508, 510, 512), respectively. In the illustrated embodiment of FIG. 7, the second waypoint location B (510) has the highest priority rank, the first waypoint location A (506) has the second highest priority rank, the third waypoint location C (510) has the third highest priority rank, and the fourth waypoint location D (512) has the lowest priority rank. The graph also includes the line 514 indicating the original minimum time of arrival for the vehicle system.

The pacing trip plan may be created based on the algorithm method illustrated in FIG. 4. The second waypoint location has the highest priority rank relative to the other waypoint locations. The second waypoint location has a second target arrival time window 718. The pacing trip plan may be created to ensure that the vehicle system reaches the second waypoint location within the second target arrival time window. For example, a first pacing line 724 indicates a first adjusted minimum arrival time that includes an increase 726 in time from the original minimum time of arrival (e.g., line 514). For example, the vehicle system will operate at a slower speed according to the pacing trip plan relative to a higher speed according to the original trip plan in order to reach the second waypoint location within the second target arrival time window.

The waypoint location with the second highest priority rank is the first waypoint location. The first waypoint location is located upstream or before the second waypoint location and has a first target arrival time window 716A. The pacing trip plan designates operational settings of the vehicle system to ensure that the vehicle system reaches the second waypoint location within the second target arrival time window, but the vehicle system operating according to the pacing trip plan causes the vehicle system to reach the first waypoint location at a time that is outside of the first target arrival time window. It is determined that the vehicle system will need to arrive at the first waypoint location within a first actual arrival time window 716B (e.g., the minimum value between the first adjusted minimum arrival time, first pacing line 724, and the first target arrival time window).

The waypoint location with the third highest priority is the third waypoint location. The third waypoint location is located downstream or after the second waypoint location (e.g., with the highest priority rank) and has a third target arrival time window 720. It is determined that it is feasible for the vehicle system to reach the third waypoint location within the third target arrival time window. For example, the vehicle system is capable of arriving at the third waypoint location within the third target arrival time window (e.g., the maximum value between the adjusted minimum arrival time, first pacing line 724, and the third target arrival time window) while the vehicle system is operated according to the pacing trip plan. A second pacing line 734 indicates a second adjusted minimum arrival time that includes an increase 736 in time from the first adjusted minimum arrival time. For example, the vehicle system will operate at a slower speed according to the pacing trip plan relative to a higher speed according to the original trip plan in order to reach the third waypoint location within the third target arrival time window.

The waypoint location with the lowest priority rank is the fourth waypoint location. The fourth waypoint location is located downstream or after the third waypoint location (e.g., with the higher priority rank relative to the fourth waypoint location) and has a fourth target arrival time window 722A. The pacing trip plan designates operational settings of the vehicle system to ensure that the vehicle system reaches the second waypoint location (e.g., with the highest priority rank) within the second target arrival time window, but the vehicle system operating according to the pacing trip plan causes the vehicle system to reach the fourth waypoint location at a time that is outside of the fourth target arrival time window. It is determined that the vehicle system will need to arrive at the fourth waypoint location within a fourth actual arrival time window 722B (e.g., the maximum value between the first adjusted minimum arrival time, first pacing line 724, and the fourth target arrival time window).

Additionally, the pacing trip plan also ensures that the vehicle system reaches the third waypoint location (e.g., with the higher priority rank relative to the fourth waypoint location) within the third target arrival time window, but the vehicle system operating according to the pacing trip plan causes the vehicle system to reach the fourth waypoint location at a time that is outside of the fourth actual arrival time window. It is determined that the vehicle system will need to arrive at the fourth waypoint location within a fourth adjusted actual arrival time window 722C (e.g., the maximum value between the second adjusted minimum arrival time, second pacing line 734, and the fourth actual arrival time window). For example, the actual time of arrival of the vehicle system to reach the fourth waypoint location is adjusted a first time to ensure that the vehicle system arrives at the second waypoint location within the second target arrival time, and adjusted a second time to ensure that the vehicle system arrives at the third waypoint location within the third target arrival time.

In one embodiment, the controllers or control systems described herein may have a local data collection system deployed and may use machine learning to enable derivation-based learning outcomes. The controllers may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based at least in part on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based at least in part on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used making determinations, calculations, comparisons and behavior analytics, and the like.

In one embodiment, the controllers may include a policy engine that may apply one or more policies. These policies may be based at least in part on characteristics of a given item of equipment or environment. With respect to control policies, a neural network can receive input of a number of environmental and task-related parameters. These parameters may include, for example, operational input regarding operating equipment, data from various sensors, location and/or position data, and the like. The neural network can be trained to generate an output based at least in part on these inputs, with the output representing an action or sequence of actions that the equipment or system should take to accomplish the goal of the operation. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

In accordance with one aspect or example of the subject matter described herein, a vehicle control system may include one or more processors that may receive a data set associated with plural waypoint locations along one or more routes. The data set may indicate plural waypoint locations, target arrival time windows for a vehicle system to reach the plural waypoint locations, and priority ranks of the plural waypoint locations. The processors may create and/or adjust a pacing trip plan based on the data set. The pacing trip plan may designate one or more operational settings of the vehicle system as a function of time, distance, and/or location. The pacing trip plan may be created and/or adjusted to direct the vehicle system to reach one or more of the plural waypoint locations within the corresponding target arrival time windows.

Optionally, the data set may include a first waypoint location at a first distance along the route and a second waypoint location at a second distance along the route that is past the first waypoint location in a direction of travel of the vehicle system. The data set may indicate that the vehicle system is to reach the first waypoint location within a first target arrival time window, and that the vehicle system is to reach the second waypoint location within a second target arrival time window. Optionally, the data set may indicate that the first waypoint location has a priority that is greater than a priority of the second waypoint location. The pacing trip plan may designate the one or more operational settings of the vehicle system to ensure the vehicle system reaches the first waypoint location within the first target arrival time window. The vehicle system operating according to the pacing trip plan may cause the vehicle system to reach the second waypoint location at a time that is outside of the second target arrival time window. Optionally, the data set may indicate that the second waypoint location has a priority that is greater than a priority of the first waypoint location. The pacing trip plan may designate the one or more operational settings of the vehicle system to ensure the vehicle system reaches the second waypoint location within the second target arrival time window. The vehicle system operating according to the pacing trip plan may cause the vehicle system to reach the first waypoint location at a time that is outside of the first target arrival time window.

Optionally, the one or more processors may create and/or adjust the pacing trip plan based on one or more of speed restrictions at one or more locations along the route. The one or more speed restrictions may designate one or more of a minimum speed limit or a maximum speed limit. The one or more processors may create and/or adjust the pacing trip plan such that the vehicle system moves at speeds that are greater than the minimum speed limit or less than the maximum speed limit. Optionally, the priority ranks of the plural waypoint locations may be designated by one or more of an owner of the vehicle system, an owner of cargo being carried by the vehicle system, an operator of the vehicle system, or a remote dispatcher. Optionally, the target arrival time windows for the vehicle system to reach the plural waypoint locations may be designated by one or more of an owner of the vehicle system or an owner of cargo being carried by the vehicle system. Optionally, the vehicle system may be a first vehicle system. The processors may create and/or adjust the pacing trip plan also based on movement of a second vehicle system moving along the one or more routes. The first vehicle system moving according tot the pacing trip plan may maintain a designated spacing from the second vehicle system along the one or more routes. Optionally, the second vehicle system may be ahead of or behind the first vehicle system. The first and second vehicle systems may travel in a same direction of travel along the one or more routes. Optionally, the one or more processors may create and/or adjust the pacing trip plan to control operation of the vehicle system to at least one or reduce fuel consumption, reduce wear on the vehicle system, increase throughput on a vehicle network, reduce emissions, or reduce noise relative to one or more of manual control of the vehicle system during the trip or controlling operation of the vehicle system according to a trip plan.

In accordance with one aspect or example of the subject matter described herein, a method may include receiving a data set associated with plural waypoint locations along one or more routes. The data set may indicate the plural waypoint locations, target arrival time ranges for a vehicle system to reach the plural waypoint locations, and priority ranks of the plural waypoint locations. A pacing trip plan may be created and/or adjusted based on the data set. The pacing trip plan may designate one or more operational settings of the vehicle system as a function of one or more of time, distance, or location. The pacing trip plan may be created and/or adjusted to direct the vehicle system to reach one or more of the plural waypoint locations within the corresponding target arrival time ranges.

Optionally, the data set may include a first waypoint location at a first distance along the route and a second waypoint location at a second distance along the route that is past the first waypoint location in a direction of travel of the vehicle system. The data set may indicate that the vehicle system is to reach the first waypoint location within a first target arrival time range and the vehicle system is to reach the second waypoint location within a second target arrival time range. Optionally, the data set may indicate that the first waypoint location has a priority that is greater than a priority of the second waypoint location. The method may include creating and/or adjusting the pacing trip plan to designate the one or more operational settings of the vehicle system to ensure the vehicle system reaches the first waypoint location within the first target arrival time range. The vehicle system operating according to the pacing trip plan may cause the vehicle system to reach the second waypoint location outside of the second target arrival time range. Optionally, the data set may indicate that the second waypoint location has a priority that is greater than a priority of the first waypoint location. The method may include creating and/or adjusting the pacing trip plan to designate the one or more operational settings of the vehicle system to ensure the vehicle system reaches the second waypoint location within the second target arrival time range. The vehicle system operating according to the pacing trip plan may cause the vehicle system to reach the first waypoint location outside of the first target arrival time range. Optionally, the method may include creating and/or adjusting the pacing trip plan also based on one or more speed restrictions at one or more locations along the one or more routes. The one or more speed restrictions may designate one or more of a minimum speed limit or a maximum speed limit. The pacing trip plan may be created and/or adjusted such that the vehicle system moves at speeds greater than the minimum speed limit or less than the maximum speed limit.

In accordance with one aspect or example of the subject matter described herein, a system may include an energy management system that includes one or more processors that may receive a data set associated with plural waypoint locations along a route. The data set may indicate the plural waypoint locations, target arrival time windows for a vehicle system to reach the plural waypoint locations, and priority ranks between the plural waypoint locations. The energy management system may create a pacing trip plan based on the data set and the priority ranks between the plural waypoint locations. The pacing trip plan may designate one or more operational settings of the vehicle system as a function of one or more of time, distance, or location. The pacing trip plan may be created to direct the vehicle system to reach one or more of the plural waypoint locations within the corresponding target arrival time windows.

Optionally, the data set may indicate that a first waypoint location has a priority that is greater than a priority of a second waypoint location. The pacing trip plan may designate the one or more operational settings for the vehicle system to ensure the vehicle system reaches the first waypoint location at a time within a first target arrival time window. The vehicle system operating according to the pacing trip plan may cause the vehicle system to reach the second waypoint location at a time outside of a second target arrival time window. Optionally, the data set may indicate that a second waypoint location has a priority that is greater than a priority of a first waypoint location. The pacing trip plan may designate the one or more operational settings for the vehicle system to ensure the vehicle system reaches the second waypoint location at a time within a second target arrival time window. The vehicle system operating according to the pacing trip plan may cause the vehicle system to reach the first waypoint location at a time outside of a first target arrival time window. Optionally, the energy management system may also create and/or adjust the pacing trip plan based on one or more speed restrictions at one or more locations along the route. The one or more speed restrictions may designate one or more of a minimum speed limit or a maximum speed limit. The processors may create and/or adjust the pacing trip plan such that the vehicle system moves at speeds that are greater than the minimum speed limit or less than the maximum speed limit. Optionally, the priority ranks between the plural waypoint locations and the target arrival time windows for the vehicle system to reach the plural waypoint locations may be designated by one or more of an owner of the vehicle system, an owner of cargo being carried by the vehicle system, an operator of the vehicle system, or a remote dispatcher. Optionally, the vehicle system may be a first vehicle system. The energy management system may create and/or adjust the pacing trip plan also based on movement of a second vehicle system moving along the route. The first vehicle system operating according to the pacing trip plan may maintain a designated spacing from the second vehicle system along the route. Optionally, the energy management system may create and/or adjust the pacing trip plan to control operation of the vehicle system to at least one of reduce fuel consumption, reduce wear on the vehicle system, increase throughput on a vehicle network, reduce emissions, or reduce noise relative to one or more of manual control of the vehicle system during the trip or controlling operation of the vehicle system according to a trip plan.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in another device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

As used herein, an element or step recited in the singular and proceeded with the word "a" or "an" do not exclude the plural of said elements or operations, unless such exclusion is explicitly stated. Furthermore, references to "one embodiment" of the invention do not exclude the existence of additional embodiments that incorporate the recited features. Moreover, unless explicitly stated to the contrary, embodiments "comprising," "comprises," "including," "includes," "having," or "has" an element or a plurality of elements having a particular property may include additional such elements not having that property. In the appended claims, the terms "including" and "in which" are used as the plain-English equivalents of the respective terms "comprising" and "wherein." Moreover, in the following claims, the terms "first," "second," and "third," etc. are used merely as labels, and do not impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function devoid of further structure.

The above description is illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein define the parameters of the inventive subject matter, they are exemplary embodiments. Other embodiments will be apparent to one of ordinary skill in the art upon reviewing the above description. The scope of the inventive subject matter should, therefore, be determined with reference to the appended claims, along with the full scope of equivalents to which such claims are entitled.

This written description uses examples to disclose several embodiments of the inventive subject matter, including the best mode, and to enable one of ordinary skill in the art to practice the embodiments of inventive subject matter, including making and using other devices or systems and performing an incorporated method. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A vehicle control system, comprising:

one or more processors configured to receive a data set associated with a first waypoint location and a second waypoint locations along a route, the data set indicating the first and second waypoint locations, target arrival time windows for a vehicle system to reach the first and second waypoint locations, and priority ranks of the first and second waypoint locations, the one or more processors configured to create or adjust a pacing trip plan based on the data set, the pacing trip plan designating one or more operational settings of the vehicle system as a function of one or more of time, distance, or location, wherein the first waypoint location is at a first distance along the route and a second waypoint location at a second distance along the route that is past the first waypoint location in a direction of travel of the vehicle system, the data set indicating that the vehicle system is to reach the first waypoint location within a first target arrival time window and the vehicle system is to reach the second waypoint location within a second target arrival time window, wherein the pacing trip plan designates the one or more operational settings of the vehicle system to ensure one of:

(i) the vehicle system reaches the first waypoint location within the first target arrival time window when the first waypoint location has a priority that is greater than a priority of the second waypoint location, wherein the vehicle system operating according to the pacing trip plan causes the vehicle system to reach the second waypoint location at a time that is outside of the second target arrival time window, or (ii) the vehicle system reaches the second waypoint location within the second target arrival time window when the second waypoint location has a priority that is greater than a priority of the first waypoint location, wherein the vehicle system operating according to the pacing trip plan causes the vehicle system to reach the first waypoint location at a time that is outside of the first target arrival time window.

2. The vehicle control system of claim 1, wherein the one or more processors are also configured to create or adjust the pacing trip plan based at least in part on one or more speed restrictions at one or more locations along the route, the one or more speed restrictions designating one or more of a minimum speed limit or a maximum speed limit, the one or more processors configured to create or adjust the pacing trip plan such that the vehicle system moves at speeds that are greater than the minimum speed limit or less than the maximum speed limit.

3. The vehicle control system of claim 1, wherein the priority ranks of the plural waypoint locations are designated by one or more of an owner of the vehicle system, an owner of cargo being carried by the vehicle system, an operator of the vehicle system, or a remote dispatcher.

4. The vehicle control system of claim 1, wherein the target arrival time windows for the vehicle system to reach the plural waypoint locations are designated by one or more of an owner of the vehicle system or an owner of cargo being carried by the vehicle system.

5. The vehicle control system of claim 1, wherein the vehicle system is a first vehicle system, the one or more processors configured to create or adjust the pacing trip plan also based on movement of a second vehicle system moving along the one or more routes, wherein the first vehicle system moving according to the pacing trip plan is configured to maintain a designated spacing from the second vehicle system along the one or more routes.

6. The vehicle control system of claim 5, wherein the second vehicle system is ahead of or behind the first vehicle system, and the first and second vehicle systems are configured to travel in a same direction of travel along the one or more routes.

7. The vehicle control system of claim 1, wherein the one or more processors are configured to create or adjust the pacing trip plan to control operation of the vehicle system to at least one of reduce fuel consumption, reduce wear on the vehicle system, increase throughput on a vehicle network, reduce emissions, or reduce noise relative to one or more of manual control of the vehicle system during the trip or controlling operation of the vehicle system according to a trip plan.

8. A method, comprising:

receiving, by one or more processors, a data set associated with a first and second waypoint locations along a route, the data set indicating the first and second waypoint locations, target arrival time ranges for a vehicle system to reach the plural waypoint locations, and priority ranks of the first and second waypoint locations, wherein the first waypoint location is at a first distance along the route and a second waypoint location at a second distance along the route that is past the first waypoint location in a direction of travel of the vehicle system, the data set indicating that the vehicle system is to reach the first waypoint location within a first target arrival time window and the vehicle system is to reach the second waypoint location within a second target arrival time window; and creating or adjusting a pacing trip plan based on the data set, the pacing trip plan designating one or more operational settings of the vehicle system as a function of one or more of time, distance, or location, wherein the pacing trip plan designates the one or more operational settings of the vehicle system to ensure one of:

(i) the vehicle system reaches the first waypoint location within the first target arrival time window when the first waypoint location has a priority that is greater than a priority of the second waypoint location, wherein the vehicle system operating according to the pacing trip plan causes the vehicle system to reach the second waypoint location at a time that is outside of the second target arrival time window, or (ii) the vehicle system reaches the second waypoint location within the second target arrival time window when the second waypoint location has a priority that is greater than a priority of the first waypoint location, wherein the vehicle system operating according to the pacing trip plan causes the vehicle system to reach the first waypoint location at a time that is outside of the first target arrival time window.

9. The method of claim 8, further comprising creating or adjust the pacing trip plan also based at least in part on one or more speed restrictions at one or more locations along the one or more routes, the one or more speed restrictions designating one or more of a minimum speed limit or a maximum speed limit, the pacing trip plan designating the one or more operational settings such that vehicle system moves at speeds greater than the minimum speed limit or less than the maximum speed limit.

10. A system, comprising:

an energy management system comprising one or more processors configured to receive a data set associated with a first and second waypoint locations along a route, the data set indicating the first and second waypoint locations, target arrival time windows for a vehicle system to reach the first and second waypoint locations, and priority ranks between the first and second waypoint locations, the energy management system configured to create a pacing trip plan based on the data set and the priority ranks between the first and second waypoint locations, the pacing trip plan designating one or more operational settings of the vehicle system as a function of one or more of time, distance, or location, the pacing trip plan created to direct the vehicle system to one of:

(i) when the data set indicates that the first waypoint location has a priority that is greater than a priority of the second waypoint location, reach the first waypoint location at a time within a first target arrival time window, wherein the vehicle system operating according to the pacing trip plan causes the vehicle system to reach the second waypoint location at a time outside of a second target arrival time window, or (ii) when the data set indicates that the second waypoint location has a priority that is greater than a priority of the first waypoint location, wherein the pacing trip plan designates the one or more operational settings for the vehicle system to ensure the vehicle system reaches the second waypoint location at a time within a second target arrival time window, wherein the vehicle system operating according to the pacing trip plan causes the vehicle system to reach the first waypoint location at a time outside of a first target arrival time window.

11. The system of claim 10, wherein the energy management system is also configured to create or adjust the pacing trip plan based on one or more speed restrictions at one or more locations along the route, the one or more speed restrictions designating one or more of a minimum speed limit or a maximum speed limit, the one or more processors configured to create or adjust the pacing trip plan such that the vehicle system moves at speeds that are greater than the minimum speed limit or less than the maximum speed limit.

12. The system of claim 10, wherein the priority ranks between the first and second waypoint locations and the target arrival time windows for the vehicle system to reach the first and second waypoint locations are designated by one or more of an owner of the vehicle system, an owner of cargo being carried by the vehicle system, an operator of the vehicle system, or a remote dispatcher.

* * * * *